US008544116B2

(12) United States Patent
Lumpiesz

(10) Patent No.: US 8,544,116 B2
(45) Date of Patent: Oct. 1, 2013

(54) GOLF GLOVE

(76) Inventor: Lance Lumpiesz, Pinckney, MI (US)

( * ) Notice: Subject to any disclaimer, the term of this patent is extended or adjusted under 35 U.S.C. 154(b) by 1734 days.

(21) Appl. No.: 11/558,968

(22) Filed: Nov. 13, 2006

(65) Prior Publication Data

US 2008/0109936 A1 May 15, 2008

(51) Int. Cl.
*A41D 19/00* (2006.01)

(52) U.S. Cl.
USPC ..... 2/161.2; 2/159; 473/205

(58) Field of Classification Search
USPC ..... 2/161.2, 161.1, 159, 16; 273/DIG. 30, 273/317.2; 473/205
See application file for complete search history.

(56) References Cited

U.S. PATENT DOCUMENTS

| | | | | |
|---|---|---|---|---|
| 3,848,874 | A | 11/1974 | Elkins, Jr. | |
| 4,962,547 | A | 10/1990 | Minnick | |
| 5,028,050 | A * | 7/1991 | Freyer | 473/205 |
| 5,184,815 | A * | 2/1993 | Maddox | 473/458 |
| 5,323,225 | A * | 6/1994 | Dyott | 356/73.1 |
| 5,462,280 | A | 10/1995 | Dickerson | |
| 5,542,126 | A * | 8/1996 | Harvanek | 2/161.2 |
| 5,634,214 | A | 6/1997 | St. Ville | |
| 5,836,828 | A | 11/1998 | Sinton | |
| 6,212,687 | B1 * | 4/2001 | Kwon | 2/161.3 |
| 6,513,166 | B1 * | 2/2003 | Landis | 2/161.4 |
| 6,698,027 | B2 * | 3/2004 | Park | 2/161.2 |
| 2004/0107476 | A1 * | 6/2004 | Goldwitz | 2/159 |

* cited by examiner

*Primary Examiner* — Richale Quinn
(74) *Attorney, Agent, or Firm* — Gifford, Krass, Sprinkle, Anderson & Citkowski, P.C.

(57) ABSTRACT

A pair of golf gloves is provided with indicia that aids in properly gripping a golf club whether the grip employed is a conventional grip or a natural golf grip.

2 Claims, 3 Drawing Sheets

GOLF GLOVE

The present invention is directed to golf gloves and, more particularly, to such gloves provided with indicia for indicating the proper grip of the golf club.

BACKGROUND OF THE INVENTION

The golfer's grip on the golf club is very important in achieving a proper golf swing. Heretofore, numerous devices have been provided in an attempt to ensure that the proper grip is achieved and maintained. These have taken the pair of golf gloves provided with means such as Velcro® fasteners to retain the gloves together during the golf swing. Others have provided visible indicators on the gloves which aid in properly aligning the hands as the golf club is gripped.

U.S. Pat. No. 4,962,547 provides a single glove with an indicator panel formed on the backside of the glove which presumably is visible when a proper orientation of the hands on the club is achieved, and is not visible if the grip is of each glove and on the palm and on the fingers of the gloves to aid in achieving a proper grip.

Applicant has found that if the thumbs of the user are properly aligned, the desired grip can be achieved. Further, this is true when either a so-called conventional golf grip is employed or when the golfer instead uses a natural grip.

The present invention provides a pair of gloves for a golfer provided with a first set of indicia for properly aligning the thumbs of the golfer when the golfer is improper.

U.S. Pat. Nos. 3,848,874; 4,962,547 and 5,634,214 each show a single golf glove with indicia to aid in providing proper alignment of the hands as the ball is addressed.

Each of these patents employ a single golf glove in an attempt to achieve proper positioning of both hands of the golfer.

U.S. Pat. No. 5,836,828 discloses a Golf Training System which employs a set of golf gloves, one for each hand, with indicia on each to aid in properly aligning the club in the hands of the golfer. The indicia takes the pair of a series of markings employed on the thumb employing a conventional grip and a second set of indicia to properly align the golfer's thumbs when the golfer is utilizing a natural grip.

DESCRIPTION OF THE DRAWINGS

A better understanding of the present invention can be had by referring to the drawings in which.

Figure 3:
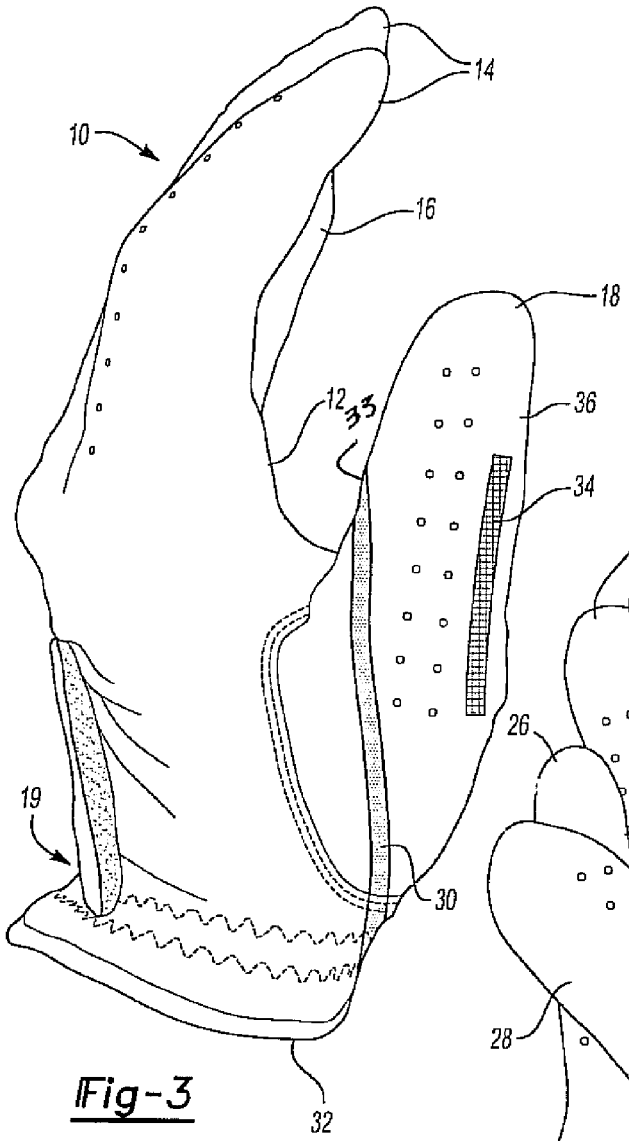
FIG. 3 is a perspective view of the left-hand glove of the present invention.
Figure 4:
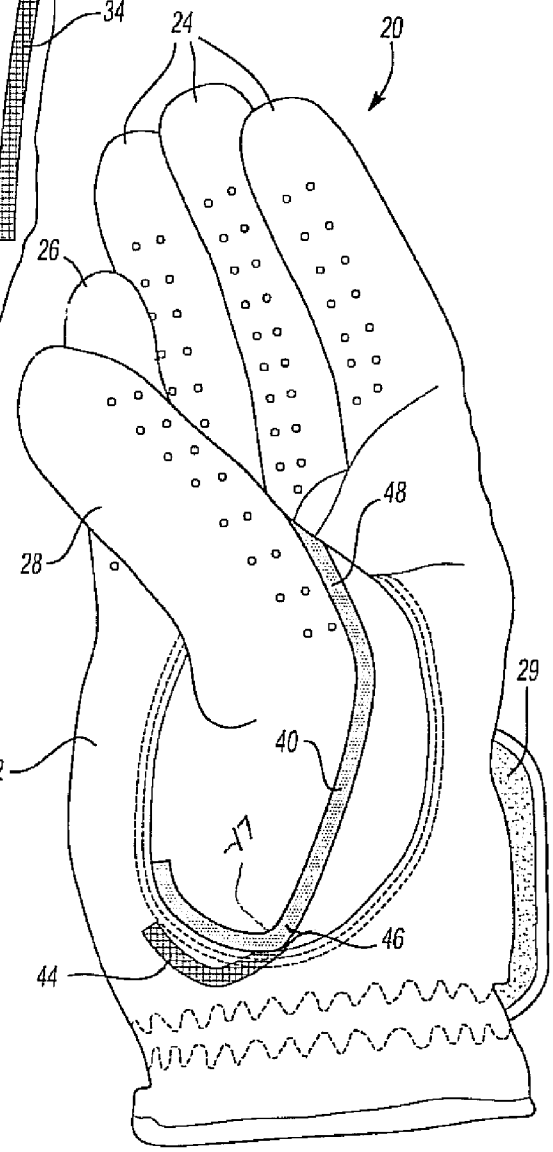
FIG. 4 is a perspective view of the right-hand glove of the present invention.

As best seen in FIGS. 3 and 4, the golf gloves of the present invention are similar in construction to conventional golf gloves with the left-hand glove 10 (FIG. 3) including a palm area 12, fingers 14, including a little finger 16 and a thumb 18. The glove 10 is intended to fit over the left hand of a golfer and includes a conventional fastening means 19 to hold the glove 10 in place.

As best seen in FIG. 4, a right-hand glove 20 is shown as including a palm area 22, fingers 24, a little finger 26, and a thumb 28. The glove 20 is intended to fit over the right hand of a golfer, and also includes conventional fastening means 29 to hold the right-hand glove in place.

Still referring to FIGS. 3 and 4, each of the gloves 10 and 20 is provided with two sets of indicia. On glove 10, the first indicia takes the form of a line 30 extending from near lower edge 32 of the glove 10 along the thumb 18 to a point substantially at the mid-point of the length of the thumb 18.

The second indicia takes the form of a second line 34 formed on the thumb 18 spaced outwardly from the line 30 and substantially parallel with the outer edge 36 of the portion glove 10 forming the thumb 18.

Still referring to FIG. 3, the line 30 is spaced from the line 34 but is not parallel to line 34. Instead, the line 30 diverges slightly inwardly toward the fingers 16. To distinguish the indicia, for a reason will become apparent as the description proceeds, it is preferred that line 30 and line 32 be of different colors or patterns with, for instance, line 30 being black and line 32 being red. Other colors and differing patterns can be used to create the desired contact and it is not even necessary that the lines 30 and 32 be of differing colors or patterns.

Two sets of indicia are also provided on the right-hand glove 20 as shown in FIG. 4. The first indicia is in the form of a first line 40 which starts at the palm 22 of the glove 20 below the thumb 18 and which curves at 47 and extends upwardly toward but below the thumb 28 to a point 48 at the edge 46 of the thumb 28 about mid-point along the length of the thumb 28. It is preferred that the color or pattern used to form the line 40 matches the color or pattern used to form line 30 on glove 10.

A second indicia is provided on glove 20 in the form of a line 44. The line 44 is relatively short and extends along and below the line 40 from the palm 22 of the glove 20 to intersect and terminate at a point 46 on line 40 when line 40 begins to extend upwardly toward the thumb 48 of the glove 20.

Line 44 is preferably of the same color or pattern as line 34 of glove 10.

Figure 1:
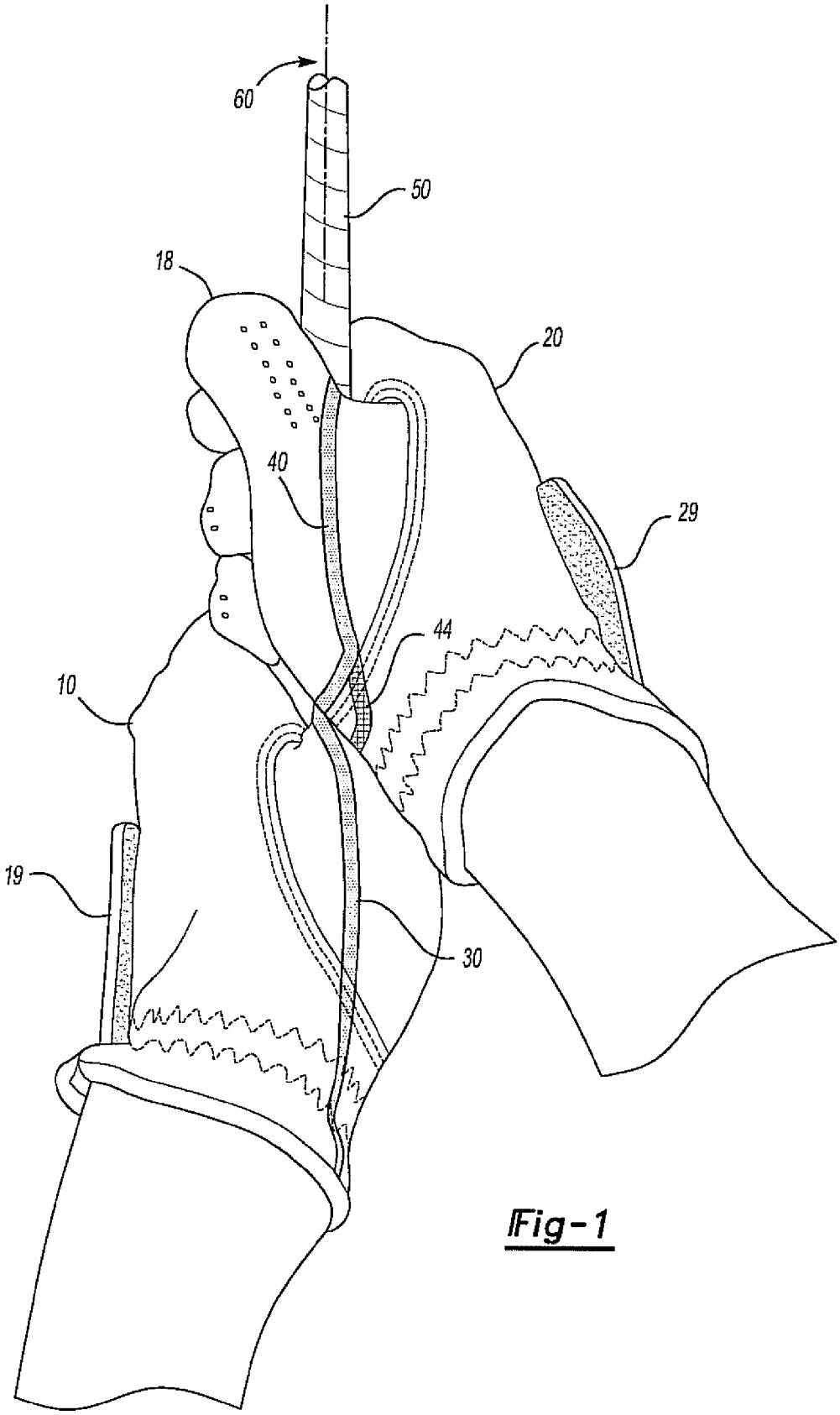
FIG. 1 is a perspective view of the gloves of the present invention being used in the conventional manner.

Referring to the drawings, FIG. 1 discloses the gloves 10 and 20 of the present invention used to grip a golf club shaft 50 in the so-called conventional manner. The grip shown is for a right-handed golfer with the left-hand glove 12 and thus the left hand of the golfer positioned near the end of the shaft 14 and the right-hand glove 20 and the right hand of the golfer positioned next to the left hand of the golfer but further along the golf club shaft 50. Also, in the conventional grip as shown in FIG. 1, the shaft 50 is first positioned in the palms of the user and the fingers 16 are then closed around the shaft 50 with the thumbs 28 and 36 in the position shown. Although not clear from FIG. 1, the conventional grip usually includes the little finger 26 of the right hand interlocked with the first finger 14 of the left hand.

Proper alignment of the thumbs with respect to the shaft 50 is the key to a proper conventional grip of the golf club and thus the correct swing. Indicia 40 on the right-hand glove 20 and indicia 30 on left-hand golf club 10 provides the means for properly aligning the thumbs of the user to achieve a proper conventional grip. As can best be seen in FIG. 1, when the thumbs are properly aligned, the lines 30 and 40 intersect and together form a substantially straight line substantially along the centerline 60 of the golf shaft 50. It should be clear that if the right hand and the left hand of the golfer are rotated even slightly from the position shown in FIG. 1, the thumbs of the golfer will not be properly aligned and the proper golf grip will not be achieved.

Figure 2:
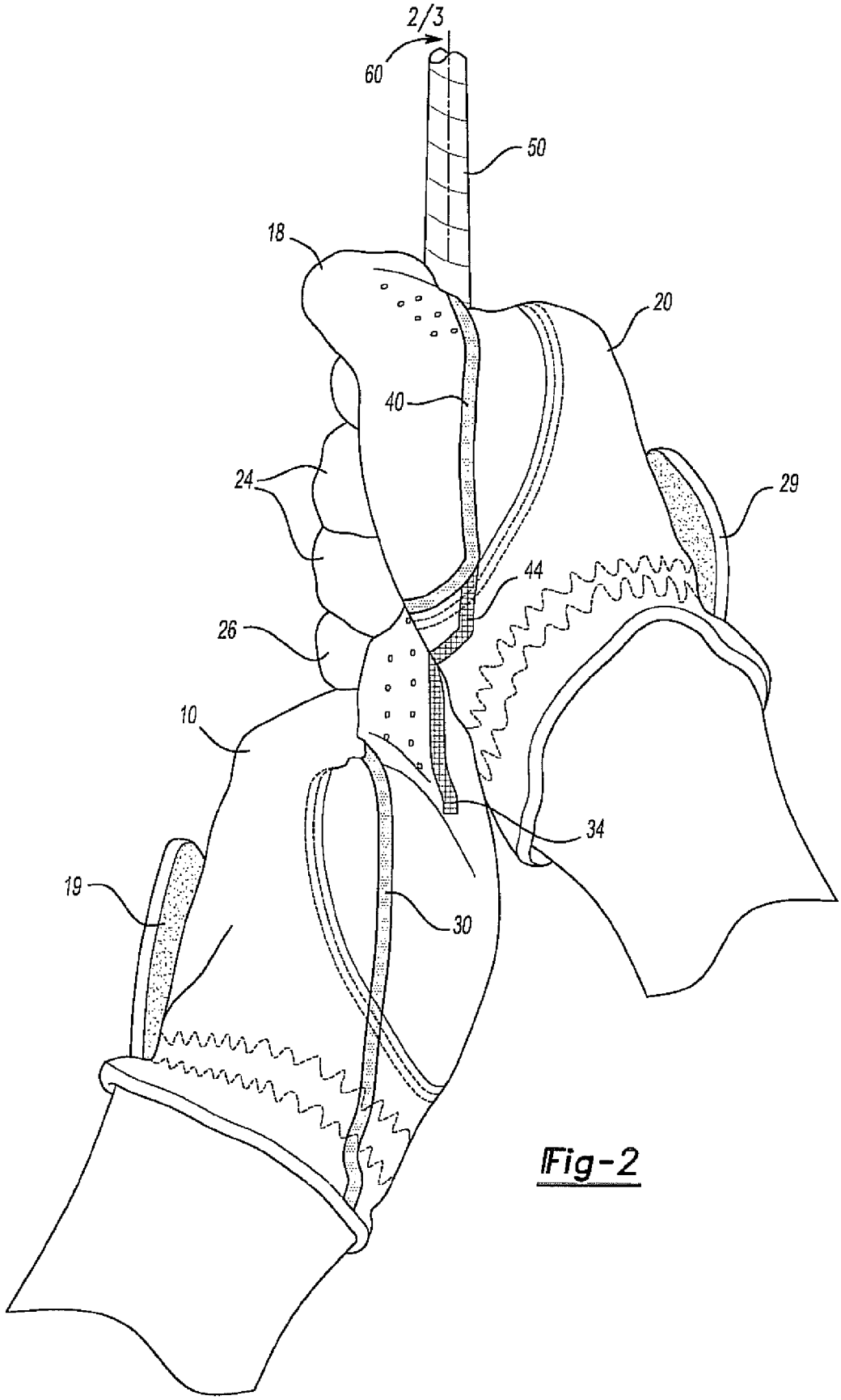
FIG. 2 is a perspective view of the gloves of the present invention being used to grip a golf club utilizing a natural grip.

FIG. 2 illustrates the gloves 10 and 20 used to achieve a so-called "natural" grip. The natural grip differs from the conventional grip in that unlike the conventional grip the golf club in the natural grip is not first positioned in the palms of the golfer. Instead, the golf club is taken in the hands of the golfer and is gripped much like the grip used to swing a baseball bat.

As can best be seen in comparing FIGS. 1 and 2, the right hand of a right-handed golfer is in a position with respect to the golf club shaft 50 which is substantially the same as the right hand using a conventional grip. The left hand, however, is rotated slightly counterclockwise as shown in FIG. 2 so that indicia lines 40 and 30 are no longer in alignment. In the proper position of hand, however, line 34 on the left-hand glove 10 intersects and aligns with line 44 of the right-hand glove 20.

It is apparent that the gloves 10 and 20 which have been described are intended for use by a right-handed golfer. For a left-handed golfer, the indicia as provided would have to be reversed; i.e., lines 40 and 44 would be provided on the left-hand glove 10, and lines 30 and 34 would be provided on the right-hand glove.

Applicant has described a pair of golf gloves which can be used to properly position the hands of a golfer whether using the conventional grip or the natural grip.

It should be apparent that changes and modifications can be made to the golf gloves as disclosed without departing from the invention as set forth in the appended claims.

I claim:

1. A pair of golf gloves for aiding in the proper grip of a golf club shaft, said golf gloves comprising:

indicia in the form of a line on one of said golf gloves which extends substantially parallel to the golf club shaft when the hand of the golfer is properly positioned on said golf club shaft to achieve a conventional grip of said golf club shaft;

said indicia including a line on the other of said gloves with the major portion of said line extending substantially co-axially with said first mentioned line when the other hand of the golfer is properly positioned on said golf club shaft to achieve a conventional grip of said golf club shaft;

a second indicia on said first mentioned glove in the form of a line extending from said first mentioned line with a portion co-axial with said first mentioned line and a second portion offset from said first portion; and said second mentioned glove having a second line intersecting the offset portion of the second line of said first mentioned glove to form a single line when the hands of the golfer are properly positioned on said golf club shaft to achieve a natural grip of said golf club shaft.

2. The gloves as defined in claim 1 and in which said lines forming said first mentioned indicia are formed of a color different than the color of the major portion of said gloves and in which said lines forming said second indicia are of a color different than said lines of said first mentioned indicia.

* * * * *